United States Patent [19]

Giancola et al.

[11] Patent Number: 4,625,433

[45] Date of Patent: Dec. 2, 1986

[54] FIBROUS PACK DRYING METHOD AND APPARATUS

[75] Inventors: Dean L. Giancola, Perrysburg; Craig D. Kowalski; Frederic H. Paetz, both of Newark, all of Ohio

[73] Assignee: Owens-Corning Fiberglas Corporation, Toledo, Ohio

[21] Appl. No.: 724,697

[22] Filed: Apr. 18, 1985

[51] Int. Cl.[4] ..... F26B 3/06

[52] U.S. Cl. ..... 34/23; 34/155; 34/160; 156/470; 68/5 D

[58] Field of Search ..... 34/155, 160, 162, 23; 68/5 D, 5 E, 6, 20; 156/470

[56] References Cited

U.S. PATENT DOCUMENTS 3,319,353 5/1967 Matsunami et al. ..... 34/162
4,490,927 1/1985 Kissell ..... 34/155

FOREIGN PATENT DOCUMENTS 588526 2/1959 Italy ..... 68/6

*Primary Examiner*—Larry I. Schwartz
*Attorney, Agent, or Firm*—Ronald C. Hudgens; Greg Dziegielewski; Ted C. Gillespie

[57] ABSTRACT

Apparatus is disclosed for introducing a gas into a porous pack the apparatus comprising gas injection means for introducing a gas into the pack, a conveyor for moving the pack into superimposed position to the gas injection means and for deflecting the gas out of the pack between the gas injection means.

7 Claims, 2 Drawing Figures

FIBROUS PACK DRYING METHOD AND APPARATUS

TECHNICAL FIELD

This invention pertains to apparatus for drying a fibrous pack, particularly a pack of mineral fibers suitable for acoustical or thermal insulation.

In one of its more specific aspects, this invention pertains to apparatus for drying packs of fibrous mineral material in which the material to be dried resides within the pack, and to packs in which the material to be dried is stratified in a particular region of the pack.

BACKGROUND OF THE INVENTION

The use of porous packs as insulation and as carriers for films or facings adhered to one surface is well known. A typical facing is a decorative vinyl sheet adhered to a glass fiber acoustical ceiling board. Such porous packs can comprise glass fibers in a heterogeneous relationship. Typical are glass fibers adhered in a cohesive mass by binders and cohesive masses of glass fibers having a film adhered to one face of the pack.

Drying and/or curing of binder is typically required for the binder in the mineral pack. When an adhesive is positioned between an applied facing and the pack, a drying step is required. Frequently, this is accomplished by passing the pack through an oven in which the volatiles in the binder or the adhesive are driven off, leaving the pack in a dry state. Such drying may require that the maximum temperature to which the facing may be safely subjected be significantly lower than the temperature that could be used to dry the adhesive. Thus, the drying medium, which is typically hot air, must not be permitted to reach the temperature at which thermal degradation of the facing occurs. This disparity must be accommodated by increasing the drying time through increased oven length, or decreased oven throughput. Another problem is that typical facings block the flow of hot air through the pack.

There has now been developed a process and apparatus which simplifies and makes more efficient the drying of mineral fiber products having a facing applied thereon.

STATEMENT OF THE INVENTION

According to this invention, there is provided apparatus for introducing a gas such as hot air, into a porous pack of mineral fibers which comprises injection means for injecting the gas into the pack, and baffle means for deflecting the gas out of the pack in a direction opposite to the direction of injection. Preferably, the injection means comprises a plurality of apertured members in spaced apart relationship to each other, forming passageways therebetween for the exit of the deflected gas from the pack.

In a specific embodiment of the invention, a facing is adhered to one side of the pack and a porous conveyor belt supports the pack and carries it past the injection means.

According to this invention, there is also provided a method for drying a porous pack which comprises introducing a gas into the pack and through substantially the entire thickness of the pack from at least two apertured members to dry a substance within the pack, and deflecting the gas out of the pack in a direction substantially opposite to the direction of the gas introduction and between the apertured members.

In a preferred embodiment of the invention, the gas is deflected out of the pack by impingement on a facing adhered to the pack.

In another preferred embodiment of the invention, the gas deflected from the pack comprises volatiles removed from the pack.

According to this invention, there is also provided a method for drying an adhesive adhering a facing to a porous pack of mineral fibers comprising injecting hot air into the pack through the unfaced side of the pack (i.e. not containing the facing), the hot air being at a temperature sufficient to dry the adhesive, deflecting the hot air in a direction opposite the direction of the introduction of the air, and removing the air from the pack.

In a preferred embodiment of the invention, the hot air is cooled by evaporation of the adhesive.

In the most preferred embodiment of the invention, the hot air is at a temperature sufficiently high for thermal degradation of the facing if applied directly thereto, but insufficiently high for thermal degradation of the facing when applied through the pack and subjected to evaporative cooling.

DESCRIPTION OF THE INVENTION

Oven-drying an adhesive in the presence of a vinyl facing, to which this invention is particularly suitable, requires that a maximum allowable oven temperature, such as 150° F., not be exceeded to avoid damaging the film. This limitation dictates the use of a larger oven than would be required were the drying temperature to be higher. The instant invention allows use of higher temperature drying air because the air is cooled by contact with the water before it contacts the film. The source of the water can be in the binder, or in the adhesive itself. The water is evaporated, causing the vinyl face to be evaporation cooled, protecting the vinyl.

The apparatus of this invention is suitable for use in introducing gas into any porous substrate, or pack, regardless of the composition thereof. For example, it can be used in conjunction with porous packs comprising glass fiber, organic synthetic fibers, natural fibers, permeable foam structures and the like.

Relatedly, it is suitable for introducing any gas into any porous pack for any purpose. For example, it can be used to introduce a vaporous reactant into a porous substrate containing a material which reacts with the vaporous reactant. It can be used to introduce air at any temperature into a porous substrate to carry volatile materials from the substrate. It can be used to introduce any gas at an elevated temperature into the pack to dry an adhesive holding a film in adherence to the pack. The invention will be disclosed in terms of the use of air without meaning to limit it to that usage.

For purposes of explanation, this invention will be described in relation to a method of drying a glue on a non-permeable facing which is adhered to a fiberglass board, that is, a mass of glass fibers held together by a binder to make the mass of fibers self-supporting over short lengths.

Figure 1:
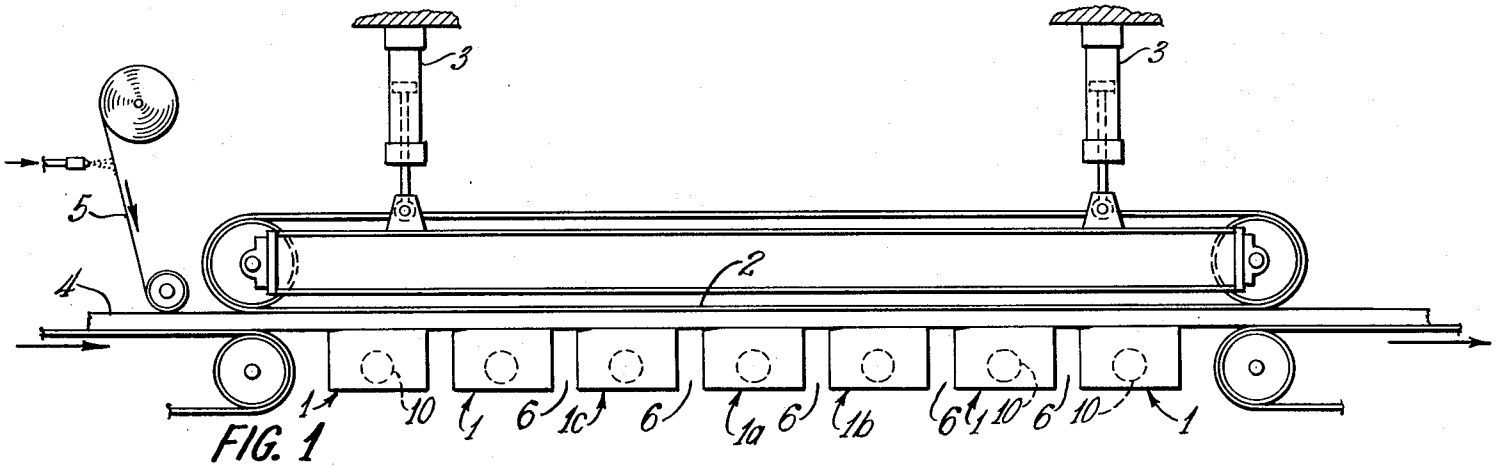
FIG. 1 is a schematic view of the apparatus of this invention.

Referring now to FIG. 1, there is shown a series of apertured air injection manifolds 1 placed in spaced relationship above which conveyor belt 2 passes in the direction indicated by the arrows. Fiberglass board 4 is introduced therebetween and by means of the downward pressure of air cylinders 3 is caused to move along the air injection manifolds in the direction of the arrows.

As the board is introduced between the conveyor and the manifolds it has an adhesive, which can be an aqueous adhesive, applied to that surface 5 which comes into contact with the board with the facing being compressed against the board in adhering relationship.

The porous board, which now serves as a substrate for the facing, then passes over one or more air injection manifolds into which heated air is introduced and from which the heated air passes into the board. The air is caused to impinge on the facing and be deflected downwardly and out of the pack and through channels 6 positioned between individual manifolds 1*a*, 1*b* and 1*c*. The air so discharged carries volatiles from contact with the binder of the pack or with the glue adhering the film to the pack and can be collected in a separate manifold, not shown, and disposed of as required.

Figure 2:
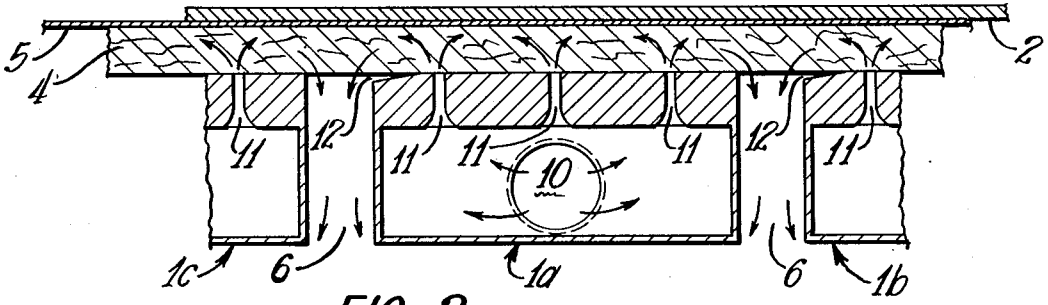
FIG. 2 is an enlargement of the gas injection means depicted in FIG. 1.

Referring now to FIG. 2, there is shown an enlarged view of a single manifold 1*a*. It is adapted with air inlet line 10 and any number of apertures or exit ports 11. There can be a multiplicity of exit ports randomly positioned across the width of the manifold or there can be one or more slots of any suitable length, including extending across the width of the conveyor. Whatever the nature of the apertures, they can be sized to provide any desired air velocity into the pack. Each manifold can have its uppermost forward edge 12 tapered to prevent interference, or tearing of the pack, as the pack moves over the manifold.

The air injection manifolds can be of any suitable number and positioned at any suitable spacing. Preferably, they will extend across the entire width of the pack and will be spaced apart a sufficient distance so that no significant pressure drop is experienced as the air flows between the manifolds. Similarly, the air outlet apertures from the manifold can be of any suitable size with the pressure of the air being supplied to the manifolds being sufficient to allow complete penetration of the pack.

In the apparatus described, the facing applied to the pack acts as the baffle means for deflecting the air out of the pack. In those applications in which no facing is applied to the pack and no deflecting baffle means is so provided, the conveyor belt, itself, serves as the baffle means.

The air introduced into the pack from the manifold will be at any suitable temperature and pressure to satisfy the necessary conditions for drying. For example, air at elevated temperatures can be employed in selected manifolds while gases at other suitable temperatures and pressures are being supplied in other of the manifolds.

The above description has assumed that the porous pack has sufficient integrity to be self-supporting and that no support therefor is required. If such is not the case, a separate conveyor, sufficiently porous so as not to impede the flow of air but not so porous as to deprive the pack of support, can be employed between the plurality of manifolds and the pack to carry the pack across the manifolds.

To facilitate the drying procedure, the conveyor can be heated in any suitable manner. By doing so, the conveyor acts as a heat source which aids in the drying process.

This apparatus can also be employed to promote a reaction within the pack. For example, a first reactant can be positioned within the pack in any suitable manner. A second reactant can then be introduced by means of the manifolds to react with the first reactant. The vapors deflected out of the pack can then comprise excess of either reactant or the carrier gas employed to carry the second reactant into the pack, or both.

While throughout this disclosure the vapor has been considered as being injected upwardly into the pack and defected downwardly out of the pack, it is possible to inject the vapor downwardly in the pack and deflect the vapor upwardly from the pack.

It will be evident from the foregoing that various modifications can be made to the apparatus of this invention. Such, however, are considered within the scope of the invention.

We claim:

1. Apparatus for drying a porous pack of mineral fibers, said pack having a facing on one side thereof, comprising a porous conveyor belt supporting and transporting said pack, and a plurality of apertured members being in spaced apart relationship to each other for injecting gas through said conveyor belt and into the unfaced side of said pack for drying, said apertured members forming therebetween passageways for the exit from said pack of gas deflected by said facing.

2. The apparatus of claim 1 in which said conveyor belt is heated.

3. The apparatus of claim 1 in which said apertured members extend across the width of said pack.

4. The apparatus of claim 1 in which said apertured members comprise slotted members, the slot of said members extending across the width of said pack.

5. The method for drying an adhesive adhering a facing to a porous pack of mineral fibers comprising:

(a) injecting hot air into said pack through the side of the pack not containing the facing, said hot air being at a temperature sufficient to dry said adhesive;

(b) deflecting said air by means of said facing in a direction opposite the direction of injection of the introduction of said air; and (c) removing air from the pack.

6. The method of claim 3 in which said hot air is cooled by evaporative cooling within the pack.

7. The method of claim 6 in which said hot air is at a temperature sufficiently high for thermal degradation of said facing if applied directly thereto, but insufficiently high for thermal degradation of said facing when applied through the pack and subjected to evaporative cooling.

* * * * *